US007406271B2

(12) United States Patent
Robinson

(10) Patent No.: US 7,406,271 B2
(45) Date of Patent: Jul. 29, 2008

(54) CONTEXTUAL FAULT HANDLING METHOD AND APPARATUS IN A PRINTING SYSTEM

(75) Inventor: David C. Robinson, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 245 days.

(21) Appl. No.: 11/135,759

(22) Filed: May 24, 2005

(65) Prior Publication Data

US 2006/0269297 A1 Nov. 30, 2006

(51) Int. Cl.
*G03G 15/00* (2006.01)

(52) U.S. Cl. ..... 399/9

(58) Field of Classification Search ..... 399/9, 399/8, 10, 11, 18, 19, 38
See application file for complete search history.

(56) References Cited

U.S. PATENT DOCUMENTS 4,500,964 A * 2/1985 Nickle ..... 714/46
4,792,827 A * 12/1988 Ogura ..... 399/81
5,129,639 A 7/1992 DeHority
5,175,735 A 12/1992 Dahlby et al.
5,363,204 A * 11/1994 Millman ..... 358/406
5,524,181 A 6/1996 Sung et al.
5,995,721 A 11/1999 Rourke et al.
6,504,621 B1 1/2003 Salgado
6,748,186 B1 6/2004 Skrainar et al.
6,782,495 B2 8/2004 Bernklau-Halvor
2003/0110412 A1 6/2003 Neville
2003/0110413 A1 6/2003 Bernklau-Halvor
2003/0118254 A1 * 6/2003 Razeti et al. ..... 383/204

FOREIGN PATENT DOCUMENTS

JP 01187620 A * 7/1989

* cited by examiner

*Primary Examiner*—Quana M Grainger
(74) *Attorney, Agent, or Firm*—Fay Sharpe LLP

(57) ABSTRACT

A contextual fault handling method and apparatus in a printing system replaces a first diagnostic message with a second diagnostic message based on a measure of fault occurrence frequency. The first message includes information relating to a symptom of a first fault and the second message includes information relating to a root cause of the first fault. Printer usage log data is collected during operation of the printing apparatus. A trend analysis is performed on the print usage log data. Then, in response to a second occurrence of a first fault event and based on a result of the trend analysis, a second diagnostic message is displayed for providing information to the operator or end user relating to a root cause of the fault. The second diagnostic message could be displayed together with the first message or as a replacement for the first message.

21 Claims, 5 Drawing Sheets

CONTEXTUAL FAULT HANDLING METHOD AND APPARATUS IN A PRINTING SYSTEM

BACKGROUND

The present application relates generally to systems and methods for automated diagnostics in marking systems and, more particularly, to methods and apparatus for generating and displaying printer diagnostic information based upon a context in which the underlying printer fault was generated. The subject methods and apparatus are particularly well suited for use in commercial printing systems and in stand alone office printing devices and will be described with particular reference thereto. However, it is to be appreciated that the methods and apparatus described herein are applicable in a wide variety of other environments including, but not limited to, networked printing devices including marking devices connected to the internet and others.

When a user has a problem with a printer, typically the user will first attempt to ascertain and fix the problem using whatever built-in diagnosis tools were provided with the printer, if any. For some printers, the built-in diagnostic tools may be in the form of a user manual or diagrams on the user interface showing possible locations of printer jams and out-of-supply notices. For printers linked to a personal computer, the install disk of the printer may include diagnostics in the form of a utility program to be run on the user's personal computer. Utility programs may offer suggestions for relatively minor problems, such as cleaning ink jets or replacing toner cartridges to improve print quality or how to ascertain a printer jam. When the local diagnostic aids are insufficient to solve the user's printing problem, the user is faced with the decision of taking the printer to a service center (which usually only occurs if the printer is small enough for the user to transport) or requesting a service call from a service technician.

In many cases, however, before a service call is placed with a service representative, the user attempts to fix the problem using diagnostic tools built into the printer. Many low and moderately priced printers include an operator interface panel with mode and control buttons and a panel adapted to display simple fault handling messages. As an example, the operator may be directed to "clear paper jam in area 1" by the printer after an internal printer fault causing a paper misfeed or mishandling. It is to be appreciated jammed paper could be the result of a more sophisticated or complicated cause than debris in the paper path, for example. In most cases, however, the root cause of the printer fault is transitory or random and, thus, does not warrant much attention beyond simple remedial actions falling within the capability tool set of typical consumers.

In the above example, a transient intermittent xerographic power supply fault causing the feed rollers to hesitate might be the underlying culprit in crumpled paper in the paper path. It is not necessary or desired, however, to direct the operator's attention to the xerographic power supply portion of the printer because of many reasons not the least of which includes the potential hazards there. More importantly, the fault is likely transitory. It is essential though that the paper jam is cleared from the paper path before successful printing can be resumed. Accordingly, in most cases, simple operator messages which provide instructions for resolving a symptom, i.e. mangled paper, to an underlying, real or root cause, i.e. xerographic fault, is adequate.

In situations when the underling or root cause of a printer error is sustained and beyond the capabilities of the end user to resolve, simply repeating messages with instructions to the operator on steps to be taken to resolve the resultant symptom of the problem such as, for example, to clear the mangled paper, adds to the frustration level of the user. Eventually, the operator may become annoyed enough to call a service technician to fix the "unseen" underlying problem.

In some more expensive mid-range and upper level printing apparatus, simple operator messages are provided together with an encoded underlying fault description. As an example, a "09-220 fault" on the 61xx family of Xerox copiers is raised when the photoreceptor belt hole sensor fails to detect the belt hole. Currently, the directed operator action is to clear the inevitable paper jam which occurs when the system is shut down. Although "09-220" portion of the fault message includes encoded information, it is incomprehensible to the operator. Further, since it is displayed each time in conjunction with the regular "clear paper jam" portions the operator would likely believe that the messages are one in the same. For infrequent occurrences of photoreceptor belt hole sensor failure, simply clearing the paper jams which would naturally occur is adequate. However, if the frequency of failure becomes large enough, the customer can become very annoyed.

Accordingly, there is a need in the art for a method and apparatus for contextual diagnostic message handling. Preferably, based upon one or more fault frequency metrics, a first diagnostic message displayed on an operator interface is replaced with a second diagnostic message based on a frequency of occurrence of the underlying fault. Such a system would alleviate the aggravation associated with displaying diagnostic messages relating to symptoms of a fault when an underlying or root cause of the fault is not repairable by the end user.

BRIEF DESCRIPTION

In accordance with a first aspect of the present application, a method is provided in a marking system adapted to display fault messages. A first diagnostic message is displayed in response to a first occurrence of a first fault event in the marking system. Thereafter, a second diagnostic message is displayed different from the first diagnostic message in response to a second occurrence of the first fault event in the marking system. Preferably, the marking system is a printing apparatus.

In accordance with a further aspect of the application, the first diagnostic message displayed includes information relating to a symptom of the first fault event in the printing apparatus. The second message, however, includes information relating to a root cause of the symptom of the first fault. In that way, an operator or end user of the printing apparatus is not frustrated by blindly following the diagnostic message relating to a symptom of the fault but, rather, is lead directly to the root cause of the fault by the second diagnostic message.

Still further in accordance with an aspect of the present application, the method includes collecting print usage log data during operation of the printing apparatus. A trend analysis is performed on the print usage log data. Thereafter, in response to a second occurrence of a first fault event and based on a result of the trend analysis, a second diagnostic message is displayed.

Still further in accordance with another aspect of the application, a fault log table is provided for storing printer status information including a time stamp and a page count in association with fault identification data for each occurrence of a fault.

Still further in accordance with yet another aspect of the application, a contextual fault handling utility displays different diagnostic messages based upon the frequency of the occurrence as determined by the trend analysis. To that end, a plurality of frequency metrics are available including a short time period between successive fault occurrences, a low number of printed sheets occurring calculated as a page count between successive fault occurrences, a short time period between x successive fault occurrences, and a low number of printed sheets between the most recent successive y occurrences of a fault. Preferably, each of the thresholds are selectable.

Yet still further in accordance with another aspect of the invention, a marking system is provided adapted to display fault messages. The marking system includes a processor, a display, and a memory storing first and second diagnostic messages and a contextual fault handling utility executable by the processor for performing contextual fault handling processing including displaying the first diagnostic message in response to a first occurrence of a first fault event in the marking system and displaying the second diagnostic message different from the first diagnostic message in response to a second occurrence of the first fault event in the marking apparatus. Preferably, the marking system includes a plurality of sensors operatively coupled with the processor for determining the first fault event. Still further, the processor is adapted to execute the contextual fault handling utility to perform a trend analysis on print usage data collected during operation of the marking system. The second diagnostic message is displayed based upon a result of the trend analysis performed on the print usage log data including marking system page count information and measures of time lapses between fault occurrences.

BRIEF DESCRIPTION OF THE DRAWINGS

FIG. 6 is a flow diagram describing in greater detail the first step of the process of FIG. 5; and.

DETAILED DESCRIPTION

Figure 1:
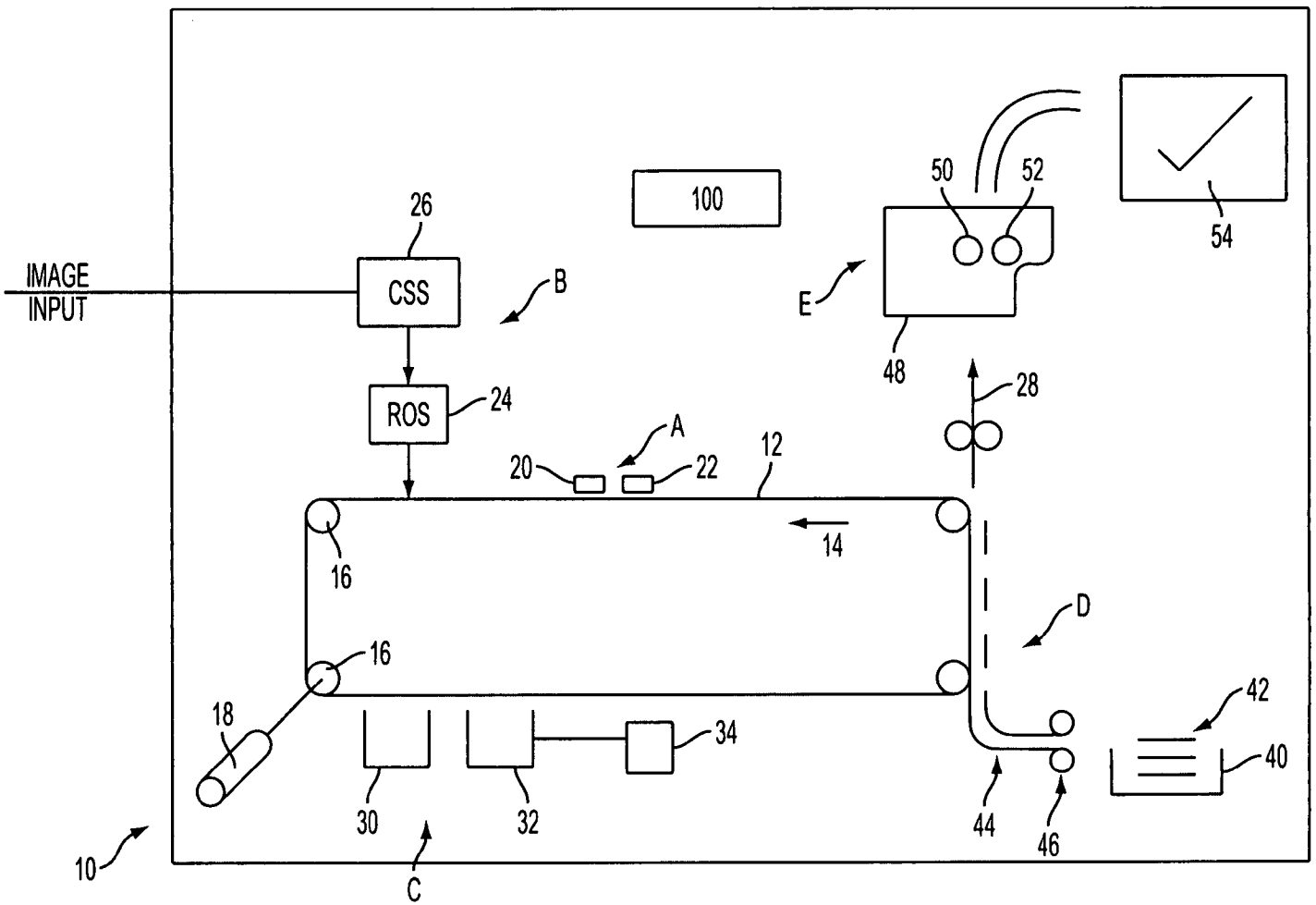
FIG. 1 is a schematic, block diagrammatic view of a reproduction system in accordance with an embodiment of the present invention.

With reference first to FIG. 1, a reproduction system 10 in which the present invention finds advantageous use is illustrated in schematic, block diagrammatic view. A belt 12 having a charge retentive surface moves in the direction of arrow 14 to advance successive portions of the belt sequentially through various processing stations disposed on the path of movement thereof. Although a belt 12 is illustrated, other forms of conveying latent images may be used as well such as, for example, a photoreceptive drum. The belt is carried on rollers 16 and at least one of the rollers is operatively connected with a drive means 18. Portions of the belt 12 pass through a charging station A. At the charging station A, a pair of corona devices 20 and 22 charge successive portions of the photoreceptor belt 12 to a relatively high, substantially uniform negative potential.

At exposure station B, the uniformly charged photoreceptor is exposed to a laser based scanning device 24 or ROS, which, in accordance with a driving CSS 26, selectively discharges portions of the photoreceptor belt to predetermined charge levels in accordance with a stored image. This records an electrostatic latent image on the belt which corresponds to the informational area contained within electronically stored original information. The ROS could be replaced with a conventional electrophotographic exposure arrangement.

A development station C includes a first developer housing 30 and a second developer housing 32 which each include a magnetic brush development system for advancing developer materials into contact with the electrostatic latent image formed on the photoreceptor. Appropriate developer biasing is accomplished via a power supply 34 which is electrically coupled with respective developer housings 30 and 32. A power supply 34 also provides all of the electromotive forces required to operate the subject reproduction system 10.

Sheets 42 of support material are advanced to a transfer station D from one or more supply trays 40, which supply trays may hold different quantities, sizes, and types of support materials. Sheets are advanced to transfer station D along a paper path 44 by rollers 46. After transfer, the sheets continue to move in the direction of arrow 28 which advances each sheet to a fusing station E.

Fusing station E, which includes a fuser assembly, indicated generally by reference numeral 48, serves to permanently affix the transfer toner powder images to the sheets. Preferably, the fuser assembly 48 includes a heated fuser roller 50 adapted to be pressure engaged with a back-up roller 52 with the toner powder image contacting fuser roller 50. In this manner, the toner powder image is permanently affixed to the sheet.

After fusing, copy sheets bearing fused images are directed to an output catch tray 54 or to a finishing station for binding, stapling, collating, etc. and removal from the machine by the operator. Alternatively, the sheets may be advanced to a duplex tray (not shown) from which it will be returned to the processor and conveyor for receiving a second side copy.

Figure 2:
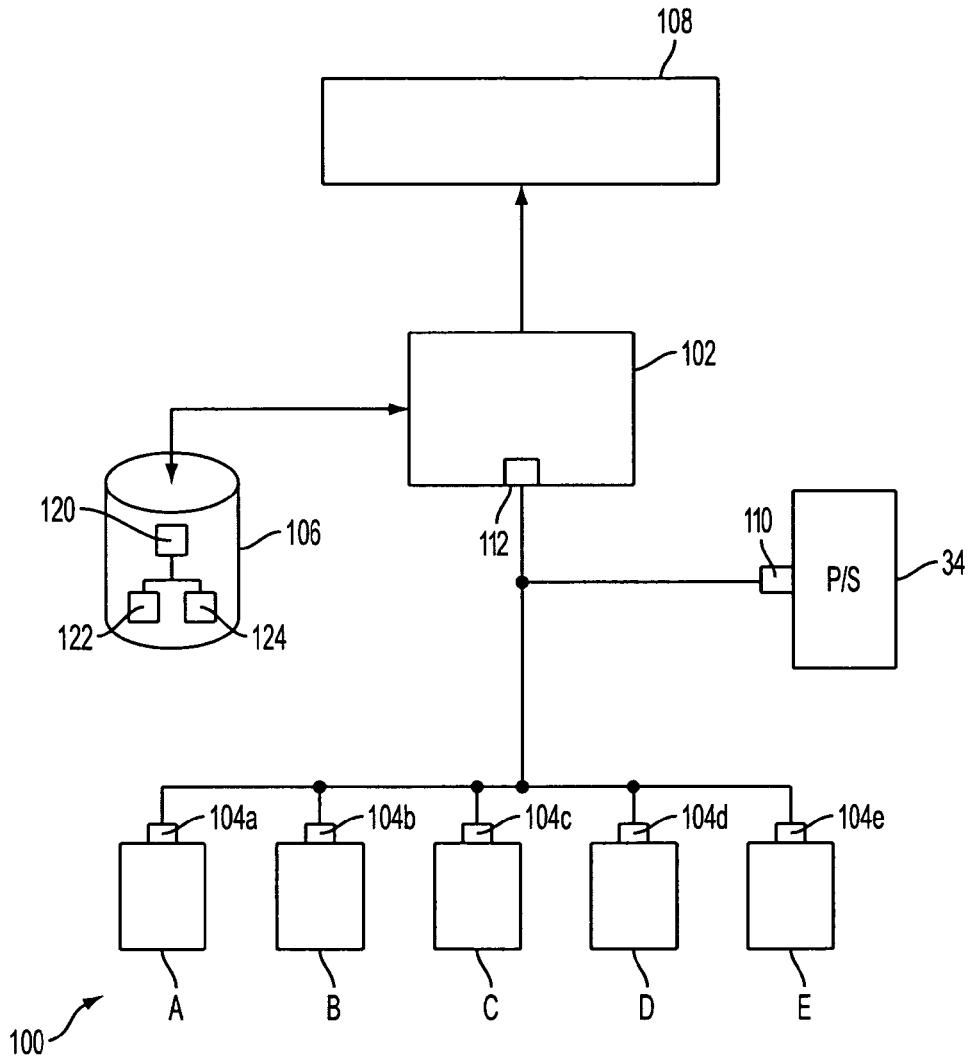
FIG. 2 is a schematic block diagrammatic view of a control circuit used in the reproduction system 10 of FIG. 1.

Referring to FIG. 2, a control circuit 100 for use with the above-described reproduction system 10 is illustrated in schematic block diagrammatic form. As illustrated, the control circuit 100 includes a processor 102 coupled to each of the stations A-E of the reproduction system 10 described above through a sensor network 104. In addition, the control circuit 100 includes a memory 106 and an operator interface 108.

In its preferred form, the sensor network 104 includes a plurality of sensors for determining a fault in each of the subsystems of the reproduction system. More particularly, a first sensor 104*a* is disposed at the charging station A for determining, by the microprocessor 102, a fault condition in the charging station A. Similarly, one or more sensors 104*b*-104*e* are disposed at each of the exposure station B, the development station C, the transfer station D, and the fusing station E of the reproduction system 10 described above. Although a single sensor is shown in the drawing, it is to be appreciated that one or more sensors may be disposed at the various stations as necessary or appropriate.

In addition to the above, the sensor network 104 includes a power sensor 110 disposed at the power supply 34 for detecting a voltage, current, overheat, or other fault conditions at the power supply. Preferably, each of the sensors are connected to the processor 102 through sensor network 104 at a node 112 provided at the processor 102. The processor is adapted to execute one or more algorithms including a series of instructions for interrogating each of the subsystems of the reproduction system 10 to determine a fault condition thereof.

In addition to the above and with continued reference to FIG. 2, the processor 102 is electrically coupled with an operator interface 108 for generating fault messages when it is determined that any of the various subsystems of the reproduction system are in a fault condition. Preferably, the operator interface 108 is an LCD panel for visual display of fault messages. However, the fault messages may be generated by the processor 102 in an electronic format for transmission to a remote location through a network (not shown) or by other means. The operator interface 108 may further be provided with one or more push buttons or other input means (not shown) to provide a means for a human operator to reset, interrogate, or otherwise interact with the control circuit 100.

Lastly with reference to FIG. 2, a memory 106 is provided in association with the processor 102. The memory is adapted to store various control utilities and operational parameters for operating the reproduction system 10. In accordance with the present application, however, the memory 106 further includes a contextual fault handling utility 120 executable by the processor 102 for performing the contextual fault handling method of the present application to be described in greater detail below. In addition, the memory 106 includes a fault log table 122 for storing fault information in association with printer status information. In addition, a fault message table 124 is provided in the memory 106 for storing various system fault messages for selective retrieval by the processor 102 and display on the operator interface 108.

Figure 3:
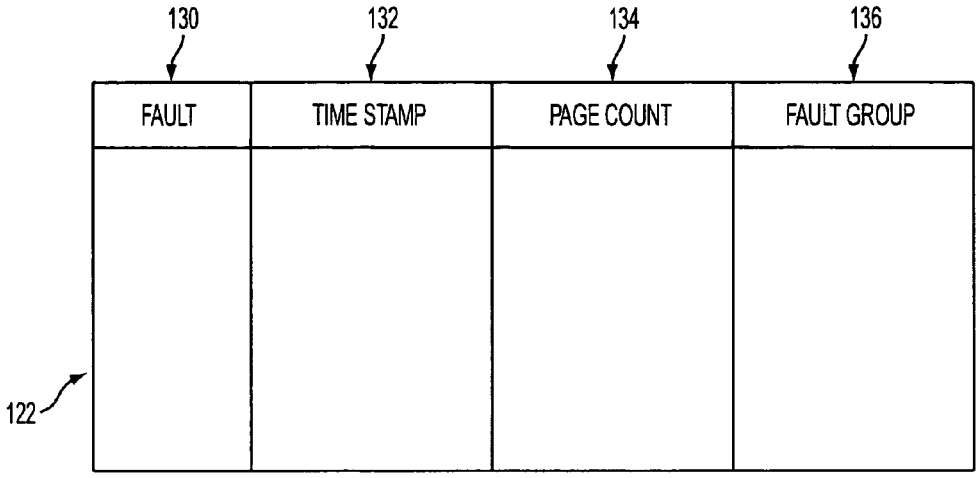
FIG. 3 is a schematic view of a fault log table used in the control circuit of FIG. 2.

Turning now to FIG. 3, the fault log table 122 is preferably in the form of a data table including a plurality of rows and columns. The fault log table is provided for storage of information collected by the processor for use in contextual fault handling. To that end, a fault identification column 130 is provided to store an identification of each fault individually as the information is collected by the processor 102. Together with the detected fault, other information is lodged in the fault log table 122 as well including printer status information such as a time stamp of the associated fault and the running printer page count total at the time of the detected fault. To that end, a time stamp column 132 is provided in the fault log table together with a page count column 134. Further, a fault group column 136 is included in the fault log table 122 so that various individual faults may be identified as belonging to a fault group having similar characteristics, conditions, likely causes, logical relatedness, common solutions, and the like. An example of a pair of faults having a common characteristic is in a DocuTech 180 HLC device available from Xerox is: a) "11-221-2 StackerB elevator failed to find home", and b) "11-223-2 StackerB failed to raise or lower in time." An example of another set of faults having a common characteristic in the DocuTech 180 HLC device example is: a) "09-220 Too long between belt holes", b) "09-637 Missing belt hole signal at marker", and c) "06-420 LRIC Unexpected belt hole detected." Lastly in connection with FIG. 3, the fault log table may include one or more additional columns for storing other printer usage information as desired.

Figure 4:
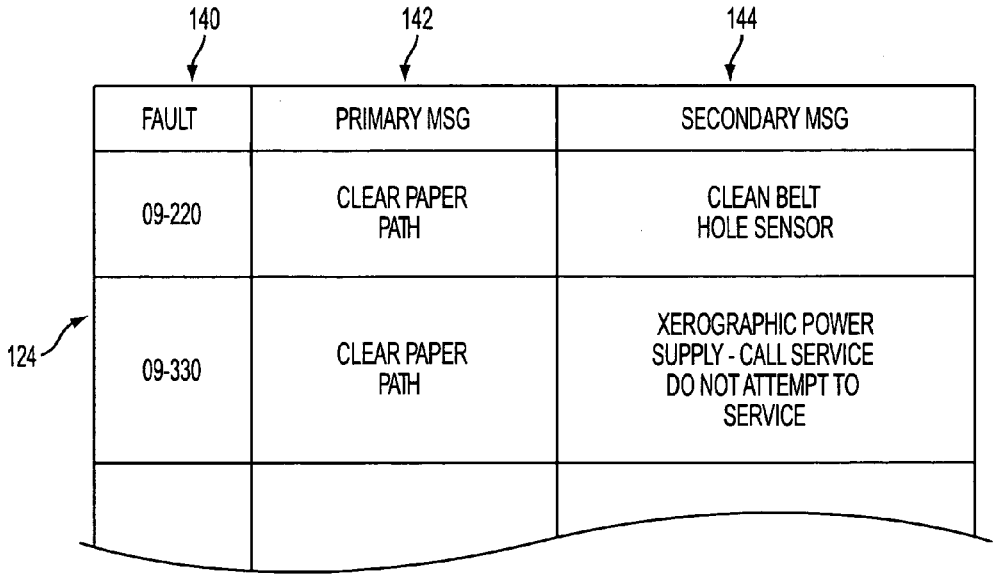
FIG. 4 is a schematic view of a fault message table used in the control circuit of FIG. 2.

Turning next to FIG. 4, a preferred embodiment of the fault message table 124 is illustrated. Similar to the fault log table discussed above, the fault message table includes a plurality of rows and columns for storing various fault messages in association with fault identification data. More particularly, a fault identification column 140 is provided for storing text identifying fault messages. A second column 142 is provided in a fault message table for storing a primary fault message for display on the operator interface in accordance with the contextual fault handling utility 120. A third column 144 is provided in the table for storing secondary fault messages for selective display based on a trend analysis performed by the contextual fault handling utility to be described in greater detail below.

By way of example, a first fault has a fault identification of "09-220" and a primary diagnostic message of "clear paper path" and is stored in the fault message table 124 in a manner illustrated. In addition to the above, the fault "09-220" is stored in the fault message table in association with a secondary diagnostic message of "clean belt hole sensor" as shown. As will be described in greater detail below, upon occurrence of a 09-220 fault, a primary diagnostic message of "clear paper path" is displayed. However, based upon the results of a trend analysis executed by the contextual fault handling utility 120, the secondary diagnostic message "clean belt hole sensor" is selectively displayed in place of the primary diagnostic message when appropriate.

Similar to the above, a second fault includes a fault identification of "09-330" and has, in the fault message table 124, primary and secondary diagnostic messages associated therewith as shown by way of example. More particularly, a primary diagnostic message of "clear paper path" is associated with fault 09-330. After a result of a trend analysis performed by the contextual fault handling utility 120, a secondary diagnostic message of "xerographic power supply-call service-do not attempt to service" is selectively displayed on the operator interface 108 in place of the primary fault message "clear paper path" when appropriate. Other fault identification data are stored in the fault message table 124 as well in association with primary and secondary fault messages.

Figure 5:
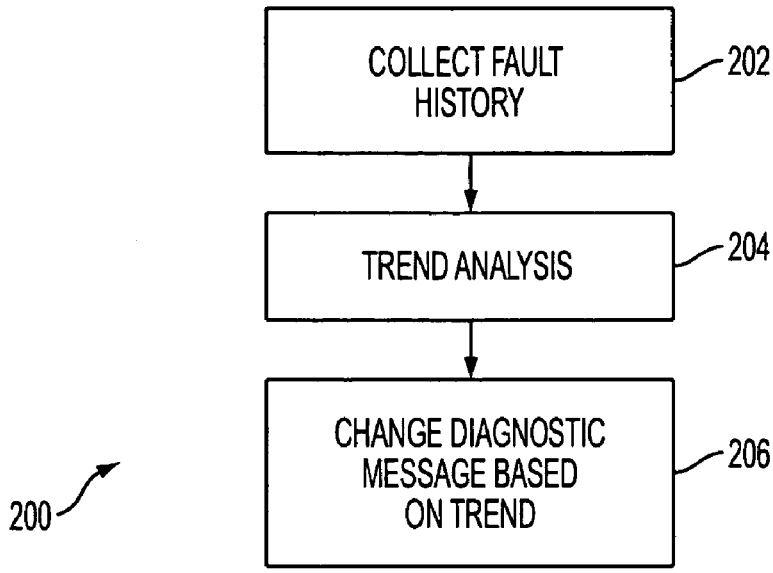
FIG. 5 is a flow diagram illustration a contextual fault handling method executed by a fault handling utility of the control circuit of FIG. 2.

With reference next to FIG. 5, a preferred embodiment of a contextual fault handling method 200 executed by the contextual fault handling utility 120 in accordance with the present application will be described. In the preferred form, the method 200 includes three overarching method steps. In a first step 202, a fault history is collected. Next, at 204, a trend analysis is performed on the fault history collected in step 202. Lastly, based on a result of the trend analysis performed in step 204, the primary fault message is replaced with a secondary fault message at step 206. It is to be appreciated that, as described above, the primary message displayed on the operator interface 108 includes information relating to a symptom of a fault detected by the processor 102 using one or more of the sensors in the sensor network 104. Based on a fault trend analysis, however, the message relating to a symptom of the first fault event is replaced with a second message including information relating to a root cause of the symptom. In that way, the diagnostic message displayed on the operator interface 108 is tailored based on a context of the underlying fault based on a trend using printer status information such as a time of fault occurrence and a page count of fault occurrence.

Figure 6:
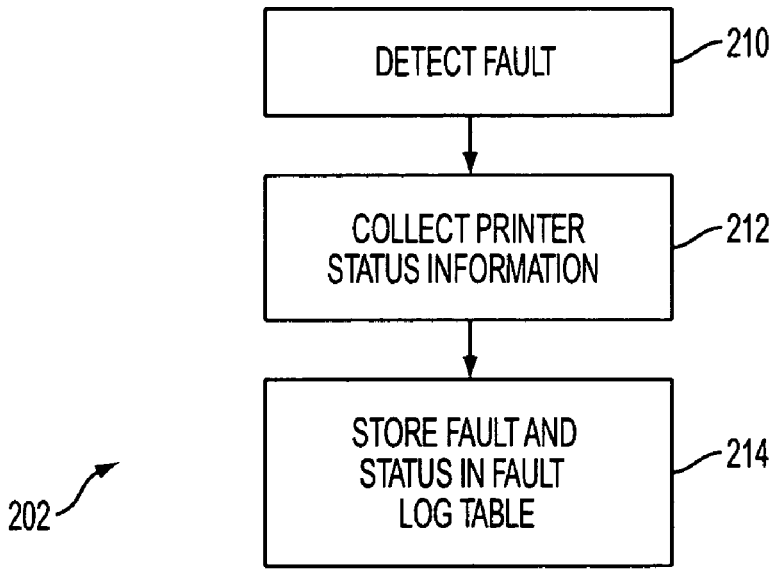

Turning now to FIG. 6, the first step 202 of the contextual fault handling method 200 is shown in detail. Preferably, in a first step 210, a fault is detected using the processor 102 and the sensor network 104. Preferably, substantially immediately after a fault is detected, printer status information is collected at step 212. The printer status information includes a time of occurrence of the fault and a page count registered in a memory or other means for storing or otherwise recording a running total of pages printed by the reproduction system 10. Next, in step 214, the fault detected in step 210 together with the printer status information collected in step 212 is stored in the fault log table 122. After the fault and associated status information are lodged in the table, control by the contextual fault handling utility 120 is shifted to the trend analysis step 204 in the contextual fault handling method 200.

Figure 7:
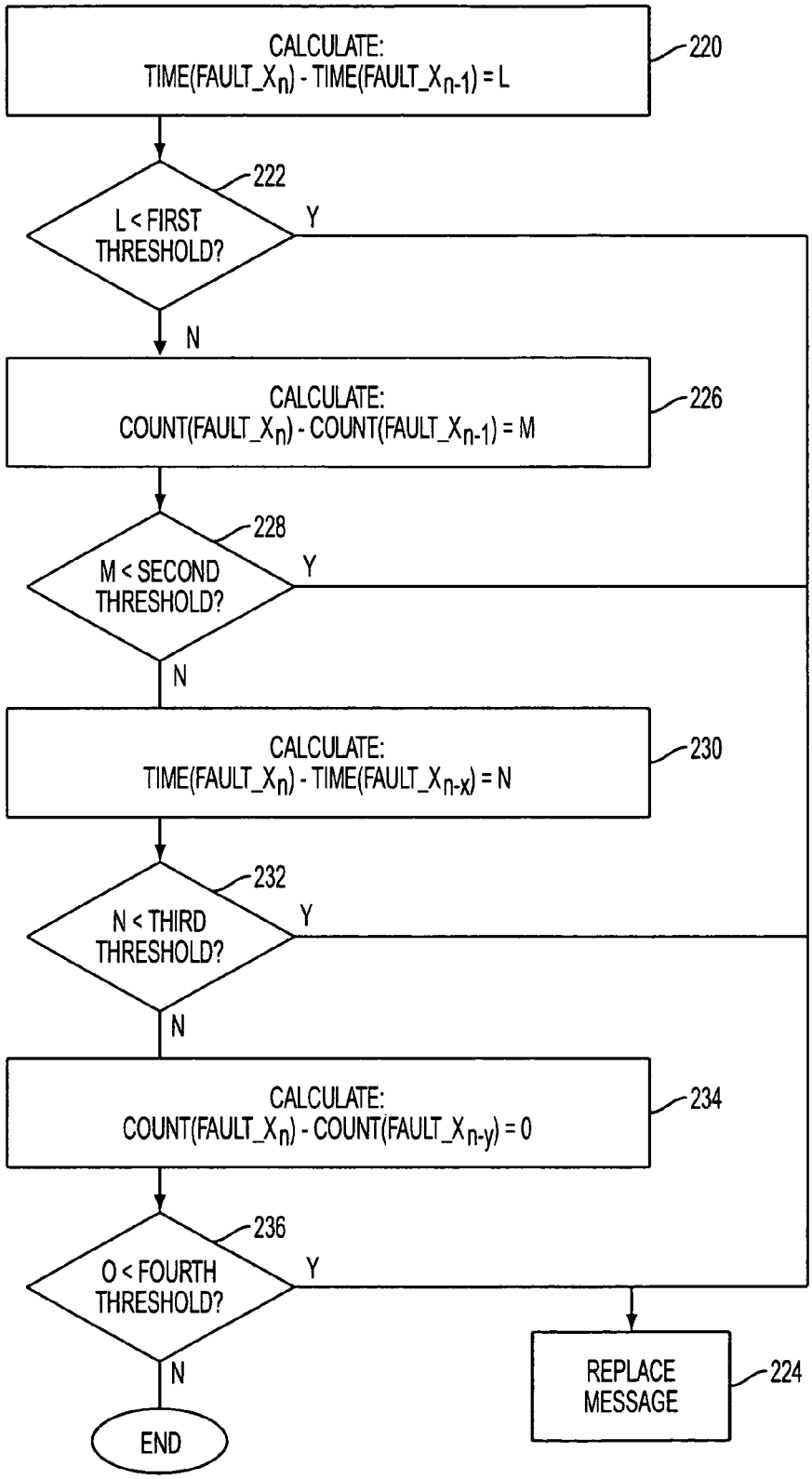
FIG. 7 is a flow diagram illustrating in greater detail the second step of the process of FIG. 5.

To that end, with reference next to FIG. 7, the trend analysis step 204 of the contextual fault handling method 200 is illustrated in greater detail. For purposes of describing the preferred trend analysis used in the instant application, certain nomenclature is used as follows next. For purposes of discussion, FAULT_$X_n$ represents the nth occurrence of FAULT_X. Further, TIME (FAULT_$X_n$) represents the time of the nth occurrence of FAULT_X. Further, COUNT (FAULT_$X_n$) represent the page count at the time of the nth occurrence of FAULT_$X_n$. With continued reference to FIG. 7, it is to be appreciated that when a fault is recognized by the processor 102, the fault log table 122 is queried so that different diagnostic messages can be posted based upon a frequency of occurrence of the fault. Many fault frequency metrics can be used to provide contextual fault handling but preferably, in accordance with preferred embodiments described herein, the frequency metrics are as shown in FIG. 7. At step 220, the time period between successive fault occurrences is calculated. In that step, the time difference A between a pair of successive occurrences of FAULT_X is calculated and, at step 222, compared against the first threshold value. When the time period is less than a predetermined threshold, a second fault message is taken from column 144 of the fault message table 124 is used to replace a primary fault message taken from column 142 of the fault message table.

At step 226, the frequency metric is in terms of page count, namely whether the page count between the last two most recent occurrences of FAULT_X below a predetermined threshold. More particularly, at step 226, the page count between successive occurrences of FAULT_X is calculated as M. Then, in step 228, the page count between a pair of successive occurrences of FAULT_X is compared against a predetermined second threshold and, if below the threshold value, the control algorithm replaces the primary diagnostic message on the operator interface 108 with a corresponding secondary diagnostic message. For example, for a fault 09-220, the primary fault message "clear paper path" is replaced with "clean belt hole sensor" message. It is to be appreciated that other frequency metrics can be used as well such as, for example, a metric in terms of fault occurrences per job count, per 100 black and white or color sheets, or the like.

At step 230, a frequency of occurrence of FAULT_X is determined between the most recent x fault occurrences. As an example, one useful frequency metric is a time period between the most recent 5 occurrences of FAULT_X. In drawing FIG. 7, however, the time period between the most recent x occurrences of FAULT_X is determined as N. At step 232, the time period determined above is compared against a third threshold and, if less than the third threshold, control is executed to replace the primary diagnostic message with a corresponding secondary message. As an example, the primary diagnostic message "clear paper path" is replaced with a secondary diagnostic message "clean belt hole sensor" for a fault having an identification of 09-220.

Lastly, another metric useful is a number of printed sheets between the last set of y occurrences of FAULT_X. To that end, at step 234, the number of printed sheets successfully processed through the reproduction system 10 between the most previous y occurrences of FAULT_X is determined as O. Next, in step 234, the number of printed sheets calculated above is compared against a fourth predetermined threshold. If the calculated page count O is less than the fourth predetermined page count, control is shifted to step 224 for replacement of the primary diagnostic message with a secondary diagnostic message.

It is to be appreciated that the above frequency metrics could be further extended to include related faults. For example, two similar xerographic cleaner faults could be considered as counting against a common threshold for occurrences. To that end, the fault lock table includes an additional column for denoting "families" of faults used in that context.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method in a marking system adapted to display fault messages, the method comprising:

displaying a first diagnostic message in response to a first occurrence of a first fault in the marking system; and, in response to a second occurrence of said first fault in the marking system and based on a measure of fault occurrence frequency, displaying a second diagnostic message different from said first diagnostic message.

2. A method in a marking system adapted to display fault messages, the method comprising:

displaying a first diagnostic message in response to a first occurrence of a first fault in the marking system, said first message including information relating to a symptom of said first fault in said marking system; and, displaying a second diagnostic message different from said first diagnostic message in response to a second occurrence of said first fault in the marking system, said second message including information relating to a root cause of said symptom of said first fault.

3. The method according to claim 2 wherein:

said displaying said information relating to said symptom of said first fault includes displaying instructions for use by an operator of the marking system to remedy the symptom of the first fault; and, said displaying said second message includes replacing said instructions for use by the operator of the marking system on a display of the marking system with said information relating to the root cause of said symptom together with a remedy message for resolving the root cause.

4. A method in a marking system adapted to display fault messages, the method comprising:

displaying a first diagnostic message in response to a first occurrence of a first fault in the marking system;

displaying a second diagnostic message different from said first diagnostic message in response to a second occurrence of said first fault in the marking system;

collecting print usage log data during operation of said marking system;

performing a trend analysis on said print usage log data; and, in response to said second occurrence of said first fault and based on a result of said trend analysis, displaying said second diagnostic message.

5. The method according to claim 4 wherein:

said performing said trend analysis includes detecting a frequency of occurrence of said first fault and comparing the detected frequency of occurrence against a predetermined threshold; and, said displaying said second diagnostic message includes displaying said second diagnostic message based on said result of said trend analysis wherein said frequency of occurrence exceeds said predetermined threshold.

6. The method according to claim 4 wherein said collecting said print usage log data during operation of said marking system includes recording, in a fault log table of the marking system, said first and second occurrences of said first fault in association with marking system status information.

7. The method according to claim 6 wherein said recording said marking system status information in association with said first and second occurrences of said first fault includes:

storing first time information at said first occurrence of said first fault as first time stamp data;

storing second time information at said second occurrence of said first fault as second time stamp data;

storing a first page count of the marking system at said first occurrence of said first fault as first page count data; and, storing a second page count of the marking system at said second occurrence of said first fault as second page count data.

8. The method according to claim 7 wherein said performing said trend analysis includes:

determining a time lapse between said first occurrence of the first fault and said second occurrence of the first fault based on said first time stamp data and said second time stamp data; and, comparing said time lapse against a predetermined time lapse threshold.

9. The method according to claim 7 wherein said performing said trend analysis includes:

determining a page count lapse between said first occurrence of the first fault and said second occurrence of the first fault based on said first page count data and said second page count data; and, comparing said page count lapse against a predetermined page count lapse threshold.

10. The method according to claim 1 wherein said displaying said second diagnostic message includes:

displaying said second diagnostic message different from said first diagnostic message in response to an nth occurrence of said first fault in the marking system.

11. A method in a marking system adapted to display fault messages, the method comprising:

displaying a first diagnostic message in response to a first occurrence of a first fault in the marking system;

displaying a second diagnostic message different from said first diagnostic message in response to an nth occurrence of said first fault in the marking system;

collecting print usage log data during operation of said marking system by recording, in a fault log table of the marking system, printer status information in association with each of said n occurrences of said first fault;

performing a trend analysis on said print usage log data; and, based on a result of said trend analysis, displaying said second diagnostic message.

12. The method according to claim 11 wherein said performing said trend analysis includes:

determining a time lapse between said first occurrence of the first fault and said nth occurrence of the first fault based on said print usage log data; and, comparing said time lapse against a predetermined time lapse threshold.

13. The method according to claim 11 wherein said performing said trend analysis includes:

determining a page count lapse between said first occurrence of the first fault and said nth occurrence of the first fault based on said print usage log table; and, comparing said page count lapse against a predetermined page count lapse threshold.

14. A marking system adapted to display fault messages comprising:

a processor;

a display operatively connected with said processor; and, a memory operatively connected with said display and said processor storing said first and second diagnostic messages and a contextual fault handling utility executable by said processor for performing contextual fault handling including displaying said first diagnostic message in response to a first occurrence of a first fault in the marking system and, in response to a second occurrence of said first fault in the marking system and based on a measure of fault occurrence frequency, displaying said second diagnostic message.

15. A marking system adapted to display fault messages comprising:

a processor;

a display operatively connected with said processor; and, a memory operatively connected with said display and said processor storing said first and second diagnostic messages and a contextual fault handling utility executable by said processor for performing contextual fault handling including displaying said first diagnostic message in response to a first occurrence of a first fault in the marking system, and displaying said second diagnostic message different from said first diagnostic message in response to a second occurrence of said first fault in the marking system, wherein said processor is adapted to execute said contextual fault handling utility to display said first message including displaying information relating to a symptom of said first fault on said display, and displaying said second message including information relating to a root cause of said symptom of said first fault.

16. The marking system according to claim 15 further including a plurality of sensors operatively connected with said processor for determining said first fault in said marking system.

17. The marking system according to claim 15 wherein:

said memory includes a usage log data table storing information relating to operational parameters of said marking system; and, said processor is adapted to collect print usage log data during operation of said marking system and store said data in said usage log data table and execute said contextual fault handling utility for performing a trend analysis on said print usage log data, and, in response to said second occurrence of said first fault and based upon a result of said trend analysis, displaying said second diagnostic message on said display.

18. The marking system according to claim 17 wherein said processor is adapted to execute said contextual fault handling utility to determine a time lapse between said first occurrence of the first fault and said second occurrence of the first fault and, based upon a comparison between said time lapse and a predetermined time lapse threshold, display said second diagnostic message.

19. The marking system according to claim 17 wherein said processor is adapted to execute said contextual fault handling utility to determine a page count between said first occurrence of the first fault and said second occurrence of the first fault based on page count data and to compare said page count against a predetermined page count threshold to display said second diagnostic message on said display.

20. The method according to claim 1 wherein:

said displaying said second message includes displaying said second message based on a measure of fault occurrence frequency including at least one of:

a short time between successive fault occurrences;

a low number of printed sheets occurring calculated as a page count between successive fault occurrences;

a short time between a predetermined number of fault occurrences; and, a low number of printed sheets between a most recent preselected number of occurrences of said first fault.

21. The marking system according to claim 14 wherein said memory stores said contextual fault handling utility executable by said processor for performing said contextual fault handling including displaying said second diagnostic message in response to said second occurrence of said first fault and based on said measure of fault occurrence frequency including at least one of:

a short time between successive fault occurrences;

a low number of printed sheets occurring calculated as a page count between successive fault occurrences;

a short time between a predetermined number of fault occurrences; and, a low number of printed sheets between a most recent preselected number of occurrences of said fault.

* * * * *